US005237143A

United States Patent [19]

Scheuchzer

[11] Patent Number: 5,237,143

[45] Date of Patent: Aug. 17, 1993

[54] PROCESS AND INSTALLATION OF ON-TRACK NEUTRALIZATION OF THE RAILS OF A RAILWAY WITH HIGH-FREQUENCY HEATING

[75] Inventor: Antoine P. Scheuchzer, Epalinges, Switzerland

[73] Assignee: Scheuchzer, S. A., Switzerland

[21] Appl. No.: 727,591

[22] Filed: Jul. 9, 1991

[30] Foreign Application Priority Data

Jul. 13, 1990 [CH] Switzerland ..... 2350/90
Jun. 25, 1991 [CH] Switzerland ..... 1869/91

[51] Int. Cl.[5] ..... H05B 5/08

[52] U.S. Cl. ..... 219/10.57; 219/10.75; 219/10.77; 219/10.79; 219/213; 104/2; 104/5; 104/15; 104/279; 246/428

[58] Field of Search ..... 219/10.57, 10.75, 10.77, 219/10.79, 6.5, 213, 10.69, 10.41; 104/2, 5, 6, 12, 10, 7.2, 9, 7.1, 148, 280, 279, 15; 105/4.1; 246/428

[56] References Cited

U.S. PATENT DOCUMENTS

| | | | |
|---|---|---|---|
| 3,505,492 | 4/1970 | Ross | 219/10.41 |
| 3,521,565 | 7/1970 | Plasser et al. | 104/2 |
| 3,566,796 | 3/1971 | Herrick | 104/2 |
| 3,705,285 | 12/1972 | Cachat | 219/10.57 |
| 3,792,533 | 2/1974 | Plasser et al. | 33/144 |
| 3,896,734 | 7/1975 | Plasser et al. | 104/2 |
| 3,936,661 | 2/1976 | Furuishi et al. | 219/528 |
| 4,158,758 | 6/1979 | Kunioka et al. | 219/10.43 |
| 4,195,805 | 4/1980 | Keep | 246/428 |
| 4,236,453 | 12/1980 | Collen | 104/15 |
| 4,272,664 | 6/1981 | Theurer | 219/53 |
| 4,300,031 | 11/1981 | Reboux et al. | 219/10.41 |
| 4,315,129 | 2/1982 | Wilkinson et al. | 219/99 |
| 4,324,184 | 4/1982 | Sullivan | 104/279 |
| 4,399,881 | 8/1983 | Theurer et al. | 177/137 |
| 4,414,454 | 11/1983 | Zollinger | 219/53 |
| 4,429,845 | 2/1984 | Stover et al. | 246/428 |
| 4,936,225 | 6/1990 | Wulf et al. | 104/247 |
| 4,955,301 | 9/1990 | Theurer et al. | 104/7.2 |
| 4,955,302 | 9/1990 | Theurer et al. | 104/7.2 |
| 4,979,247 | 12/1990 | Buhler | 104/5 |
| 5,024,380 | 6/1991 | Newman | 238/218 |

*Primary Examiner*—Bruce A. Reynolds
*Assistant Examiner*—Tu Hoang
*Attorney, Agent, or Firm*—Wegner, Cantor, Mueller & Player

[57] ABSTRACT

The process for on-track neutralization of the rails of a railway consists in causing to move past continuously along the rails (R2) at least one heating element (12), measuring continuously the value of the temperature of the rails before heating, measuring the value of the speed of movement past of the heating elements in relation to the rails, measuring the value of the change in the temperature of the rails after heating until the moment of their on-track fixing and controlling the heating of the heating elements (12) as a function of the said values.

7 Claims, 6 Drawing Sheets

PROCESS AND INSTALLATION OF ON-TRACK NEUTRALIZATION OF THE RAILS OF A RAILWAY WITH HIGH-FREQUENCY HEATING

FIELD OF THE INVENTION

The invention relates to a process and to an installation for on-track neutralization of the rails of a railway.

PRIOR ART there has already been proposed a process and a device for the neutralization of the new rails of railway tracks before their laying. This device, such as described in the Patent Applications CH 2350/90 and 2351/90 of the applicant, comprises a heating vehicle provided with wheels in order to run on the old rails, at least one heating tunnel which is intended to be traversed by the new rails during the advance of the vehicle in order to neutralize them and means for measuring and controlling the temperature of the new rails.

SUMMARY OF THE INVENTION

The object of the present invention consists in creating a process and an installation for heating which is suitable, efficient and easy to execute.

For this purpose, the process according to the invention is characterised in that:

at least one heating element is caused to move past continuously along the rails, the value of the temperature of the rails before their exposure to the heating is measured continuously, the value of the speed of movement past of the heating elements in relation to the rails is measured, the value of the change in the temperature of the rails after heating until the moment of their on-track fixing is measured, the heating of the heating elements as a function of the values is controlled or slaved.

In order to reach a suitable temperature for neutralization of the new rails at the place of their fixing, the procedure is preferably characterized in that the distance between the finish of the heating zone and the place where the neutralized new rails are fixed on the track is chosen, for a given speed of movement past of the heating elements, in such a manner that the difference in temperature between the surface and the core of the new rails does not exceed a specified value and that the temperature of the new rails in the zone of fixing corresponds, within given tolerances, to the desired temperature.

The heating of the rails is effected, preferably, by high-frequency induction, but it may likewise be produced by electrical resistance or by gas.

The installation according to the invention is characterized in that it comprises, mounted on a heating vehicle:

at least one heating element in the form of an inductor intended to be traversed by the rail to be neutralized, at least one inverter connected to the inductor in order to power it at high frequency, an apparatus for measuring the speed of movement past of a rail, sensors for measuring the temperature of the rail before its exposure to the heating and after the heating in order to measure the change in the cooling until the place of its fixing, an electronic control unit to which are connected the inverter, the apparatus and the sensors, and input units for external information and set-point values, which input units are likewise connected to the electronic control unit.

Preferred embodiments result from Claims 7 to 9.

BRIEF DESCRIPTION OF THE DRAWINGS

The invention will be described by means of two embodiments of the device for the implementation of the process for high-frequency heating, by reference to the attached drawings.

DESCRIPTION OF THE PREFERRED EMBODIMENTS

Figure 1:
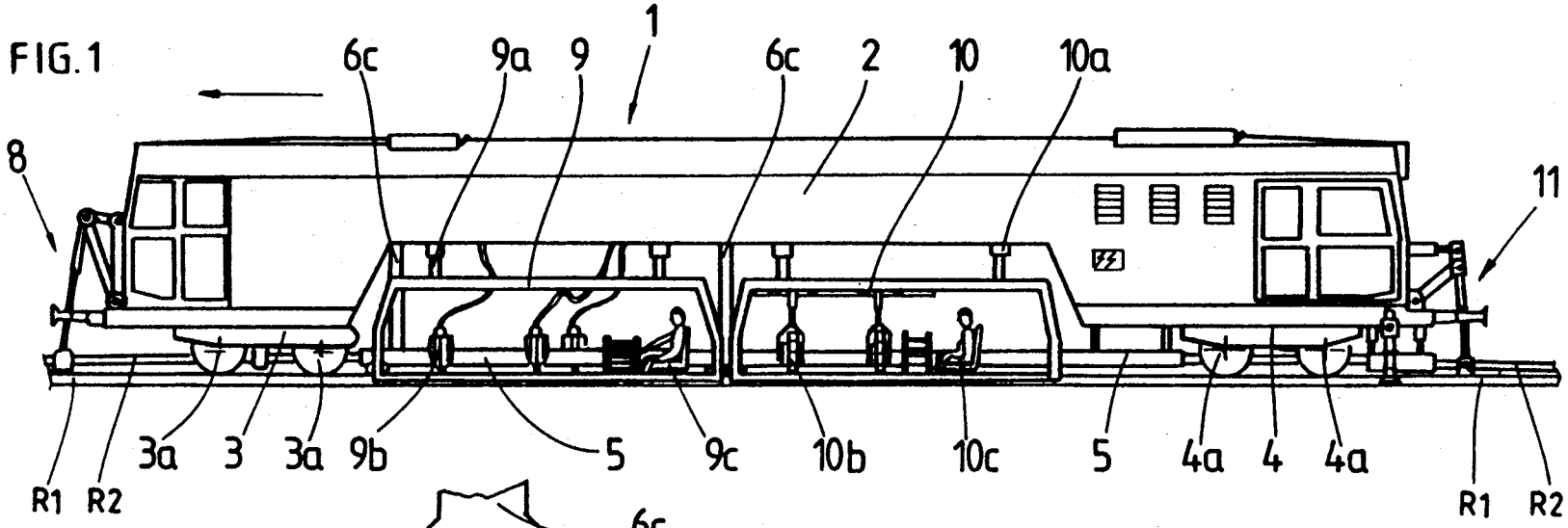
FIG. 1 shows a diagrammatic view of a heating vehicle supplied with two high-frequency heating tunnels permitting the implementation of the process according to the invention.
Figure 2:
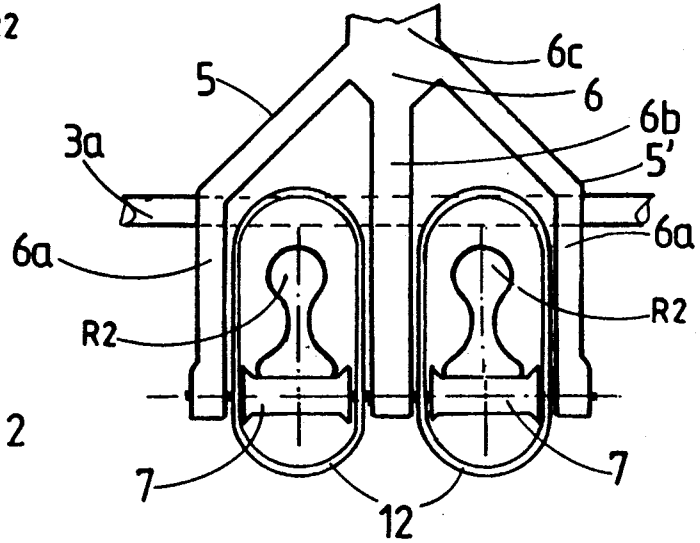
FIG. 2 is an enlarged sectional view of the tunnels alone.

By reference to FIGS. 1 and 2, there is first described briefly the example of a vehicle 1 on which is installed the heating device incorporated in the heating tunnels 5, 5'. The vehicle 1 is designed to run on the old track R1, in the direction of the arrow, in order to raise the new rails R2, which have been previously deposited along the railway track, and to neutralize them by heating immediately before their laying and, simultaneously, to detach the old rails R1 from the track. The progress of the operations is effected such as is described in the Patent Application CH 2350/90 of the applicant. Behind the vehicle 1, not shown in FIG. 1, the released old rails R1 are removed from the track and the new rails R2 are laid, as is described in the Patent Application CH 2351/90 of the applicant and in the example according to FIGS. 4 and 5.

Vehicle 1 comprises a body 2 supported by a leading bogie 3 with two axles 3*a* and by a rear bogie 4 likewise with two axles 4*a*. Between these axles 3*a*, 4*a* are installed the two heating tunnels 5, 5', one for each stretch of new rails R2 (FIG. 2).

As illustrated in FIG. 2, these two tunnels 5, 5' are mounted in common holders 6 disposed above the center of the track and suspended beneath the body 2. They are formed by two lateral walls 6*a* separated by a common central wall 6*b*. The three walls of the holder join together at their upper portion and, at specified intervals, are extended by mountings 6*c* suspended from the body 2, such that the positioning of the tunnels is centred in relation to the body 2 and consequently in relation to the track. The heating of the rails R2 to be neutralized is produced by high-frequency induction: For this purpose, the rails R2 pass on the inside of inductors in the form of one-turn coils 12, which coils are connected to inverters, and are displaced on guide rollers 7 fixed in the walls 6a, 6b of the tunnels 5, 5' between the inductors.

The disposition of these tunnels 5, 5' is such that the path of the rails R2 to be neutralized is located below the axles 3a, 4a, at a distance of between 20 to 40 cm, preferably between 25 and 30 cm, from the ballast. By virtue of this disposition, there is no need to lift the rails very high and especially above the axles, which facilitates the work and the guiding of the rails.

On either side of the tunnels 5, 5' are provided work stations in retractable platforms 9, 10 suspended from the body 2 of the vehicle by jacks 9a, 10a and on which are located automatic or manual detaching units, for example automatic sleeper-screw drivers 9b, 10b and movable seats 9c, 10c for the workers who remove the fastenings or release the fixtures of the old rails to the sleepers.

At the front of the vehicle 1 are installed means 8 for gripping the new rails R2, which have been previously disposed in the centre of the track or on either side of the track. These gripping means 8 make it possible to catch and to introduce these rails R2 into the heating tunnels 5, 5'.

At the rear of the vehicle 1 are provided rail lifters 11 which catch the heated new rails R2 at the exit of the tunnels 5, 5' and guide them on to the track where, after the old rails R1 have been removed, they will be laid and then fixed on the sleepers by known means.

By reference to FIG. 3, there will now be described the block diagram of the installation for the implementation of the process for on-track neutralization of the rails of a railway, by high-frequency induction.

This heating installation, mounted on the heating vehicle 1, comprises a heating zone formed by several inductors distributed in each tunnel 5, 5'. In the example considered there are three inductors 12, 13, 14, disposed one after the other, which are formed, in a manner known per se, by a one-turn coil produced as a hollow tube of copper, each one of a length of 1 m. These are modules of inductors of a similar construction, which are prefabricated, and this makes it possible to compose heating zones of desired length by varying the number of these modules according to need.

By utilising only three inductors of a length of 3 m, it is evident that the tunnels 5, 5' may be shorter than as indicated in FIG. 1.

The inductors 12, 13, 14 are powered by two inverters 15, 16 with a power of 100 kW and 200 kW respectively and of 1000 Hz. The inductor 12 is connected to the 100 kW inverter 15 and the inductors 13, 14 are connected to the 200 kW inverter 16, and this makes it possible to give flexibility to the adjustment of the temperature. There is further provided a refrigerator set, not shown, in order to ensure the cooling of the inductors by circulation of cold water through the hollow turns, in a closed circuit, without a continuous inflow of water from outside the convoy.

Of course, there is provided a heating installation with three modules of inductors in each one of the tunnels 5, 5' as are illustrated in FIGS. 1 and 2 and which are traversed as described hereinabove by each stretch of new rails R2.

The inverters 15, 16 are connected to an electronic control unit 17. In front of the inductors 12, 13, 14 are installed in each tunnel 5, 5' apparatuses 18 for measuring the speed of movement past of the rails R2 in relation to the vehicle 1 and sensors 19 for measuring the temperature of the rails before their exposure to the heating. In FIG. 3 there is indicated at a distance L from the finish of the heating zone, therefore at the rear end of the inductor 14, the zone ZF for fixing the new rails R2. Within this distance L are installed, at regular intervals, a plurality of sensors 20 for measuring the temperature of the rails, which sensors sense the slow cooling of the rail which occurs. Generally the rear end of the last inductor 14 coincides with the rear end of the tunnel 5, 5'.

The electronic control unit 17 to which are connected the outputs of the units 18, 19, 20, thus receives all the information on the conditions of the speed and of the temperature of the rails R2. Furthermore, this unit 17 also receives external information from an input unit 21 and set-point values from an input unit 22 via an operator control interface 23 adapted to the operational staff. The external information comprises all the essential external factors, namely the profile of the rails, the type of steel from which the rails are produced, the external temperature and, if necessary, other factors which could have an influence on the cooling speed of the rails (rain, wind, and so on).

To this unit 17 are likewise connected, as output units, a device for printing protocols 24 and an optical unit 25 for visualisation of the temperature profile and of the state of the process.

The electronic control unit 17 comprises the processing of the temperature measurements, the adjustment of the heating units, the management and the control of the process as a function of the values of the temperature of the rails before their exposure to the heating, of the speed of movement past of the heating elements in relation to the rails, and of the value of the change in the temperature of the rails after heating until the moment of their on-track fixing.

In order to reach a uniform heating of the total mass of the rails throughout their section, it is necessary, after the heating, to wait a certain time in order that the temperature during the cooling phase becomes equal throughout the total mass of the rail. For this reason, the distance L is important and will be chosen in such a manner that, for a given speed of movement past of the heating elements, the difference in temperature between the surface and the core of the new rails does not exceed a specified value and the temperature of the new rails in the zone of fixing ZF corresponds, with given tolerances, to the desired temperature.

Generally, the temperature of neutralization during the fixing must be 25° C.±0.5° C. Concerning the equalization of the temperature, it has been established that, for example for a speed of movement past of 6 m per minute, and for lengths respectively of L=8 m, L=10.5 m, L=17 m and L=21 m, the difference in temperature between the surface and the core of the rail, expressed as a percentage deviation, increases respectively to 8, 6, 4 and 3%. Thus if there is chosen an absolute deviation in the difference of the surface/core temperature of 4% at 25° C., therefore ±1° C., it is necessary to choose a length L=17 m, which corresponds to a speed of movement past of 6 m/mn in a time of 170 s. Therefore, the distance L depends principally on the admissible deviation in temperature between the surface and the core and the speed of displacement.

Figure 4A:
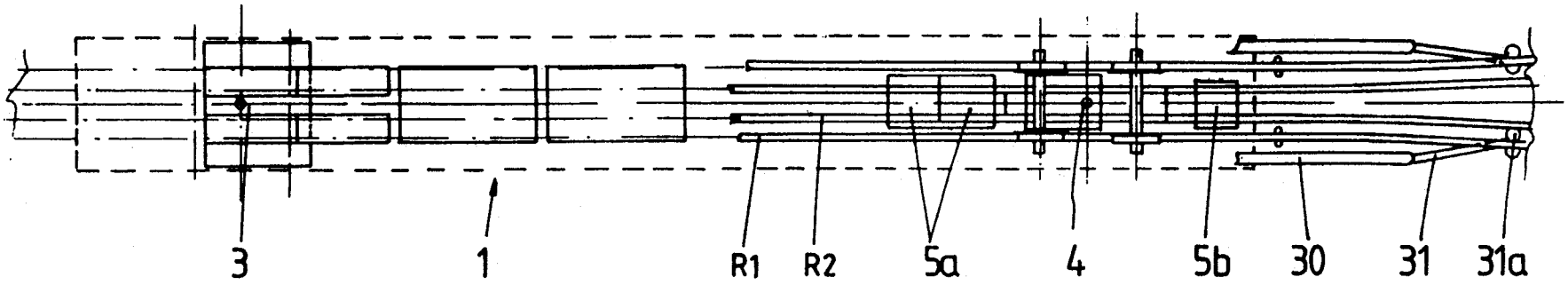
FIGS. 4*a* and 5*a* are plan views of the track in order to illustrate the positions of the old rails R1 and of the new rails R2 and their lateral displacement during the substitution, as well as some components of the vehicles.
Figure 4:
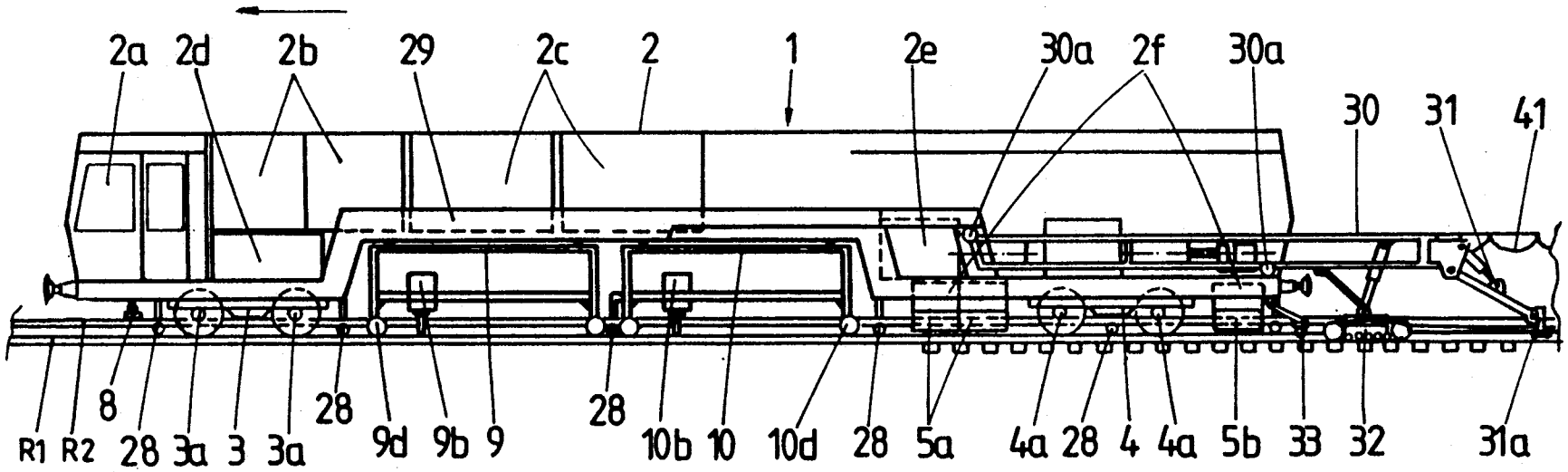
FIGS. 4 and 5 show a second embodiment of a heating vehicle followed by an assembly vehicle for the fixing of the neutralized new rails.
Figure 5A:
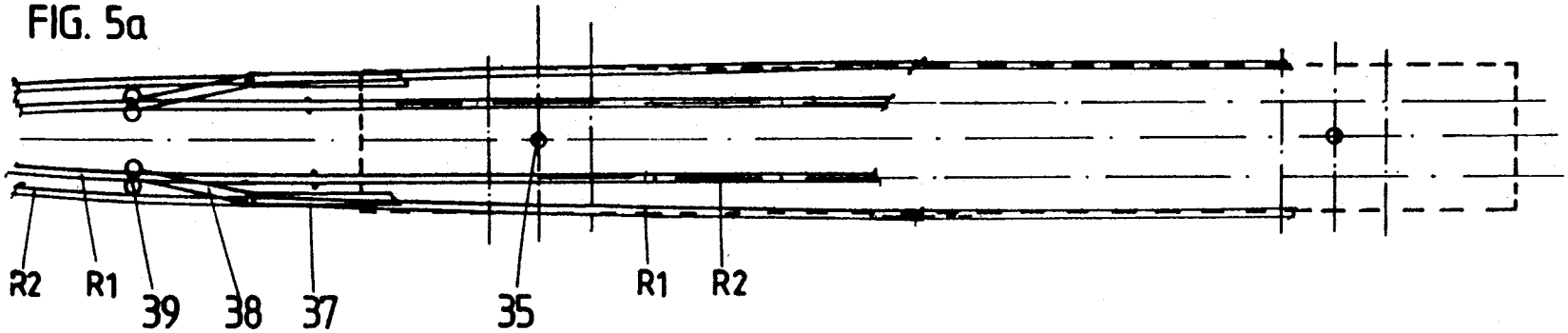
Figure 5:
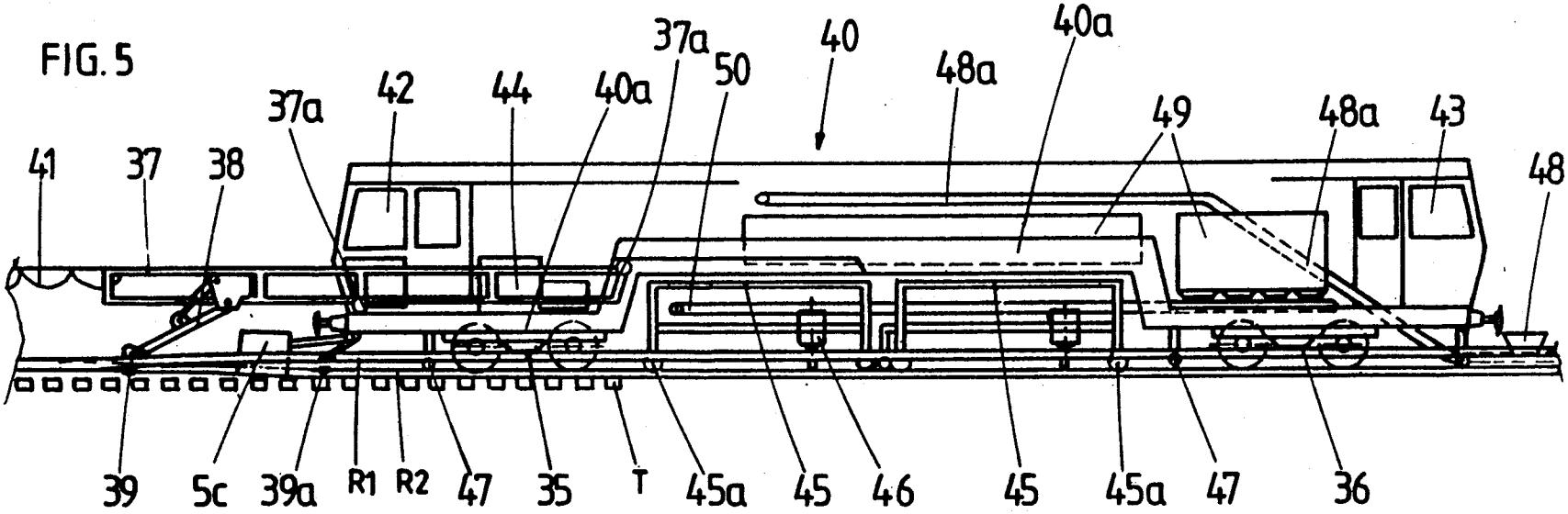

FIGS. 4 and 5 show, as a preferred example, a second embodiment of a heating vehicle 1 having shorter heating tunnels 5a, 5b, followed by a vehicle 2 for assembly of the new rails.

The parts of the heating vehicle 1 which correspond to the parts of the first example have the same reference symbols. In this case, the heating tunnels are shorter.

Vehicle 1 (FIG. 4) supplied with a leading bogie 3 and with a rear bogie 4 runs on the old rails R1 and comprises a body 2 comprising a cabin 2a, compartments 2b for inverters which supply power at high frequency to the inductors of each heating tunnel, compartments 2c for the refrigerator sets which cool the inductors, a tank 2d for the fuel oil, generator sets 2e, that supply power to the inverters, and sets of capacitors 2f, associated with the inductors. The new rails R2, previously deposited in the middle of the track, are caught at the front of the vehicle 1 by gripping means 8 and laid onto the guide rollers 28, which are fixed on the framework of the vehicle and distributed along the latter, in such a manner that the new rails R2 can pass beneath the axles 3a, 4a and between the wheels of the bogies 3 and 4.

Figure 6:
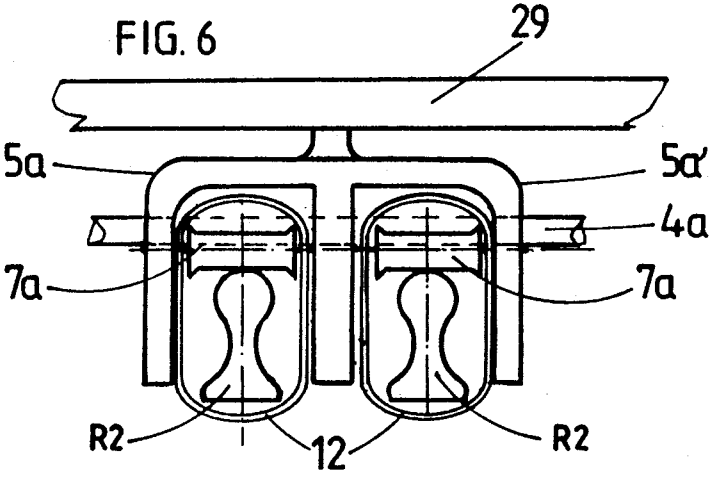
FIGS. 6 and 7 are enlarged sectional views of the tunnels of FIG. 4 according to two different variants.

The heating tunnels are installed in the zone of the rear end of the vehicle 1 in the middle of the track, in a common holder (FIG. 6). For the case considered they are divided into two parts 5a, 5b fixed to the framework 29, one situated before and the other after the rear bogie 4. The part 5a comprises two inductor units each having a length of 1 m, and therefore has a length of only 2 m, while the part 5b comprises only one inductor which is 1 m in length. Each inductor 12 has the form of a one-turn coil and is connected to a set of capacitors; the oscillating circuit formed by this coil and said capacitors is fed by the inverters. By virtue of the short length of the tunnel, the rails R2 are not required to be guided in the interior of the tunnel, but may pass through it freely. Of course, each part of the tunnel comprises two sections which are placed side by side, one for each stretch of rails, as shown in FIG. 6 for the parts 5a, 5a', which sections are provided with inductors 12 surrounding the two rails R2. In order to ensure a correct centered guiding, each part of the tunnels may be supplied with rollers 7a which bear on and run on the rails R2 passing this part, these rollers being installed before and after the inductors, respectively between the inductors. The parts of the tunnels are suspended from the framework 29 in such a manner that they are slightly movable in relation to the framework in order to allow them self-adjustment.

Figure 7:
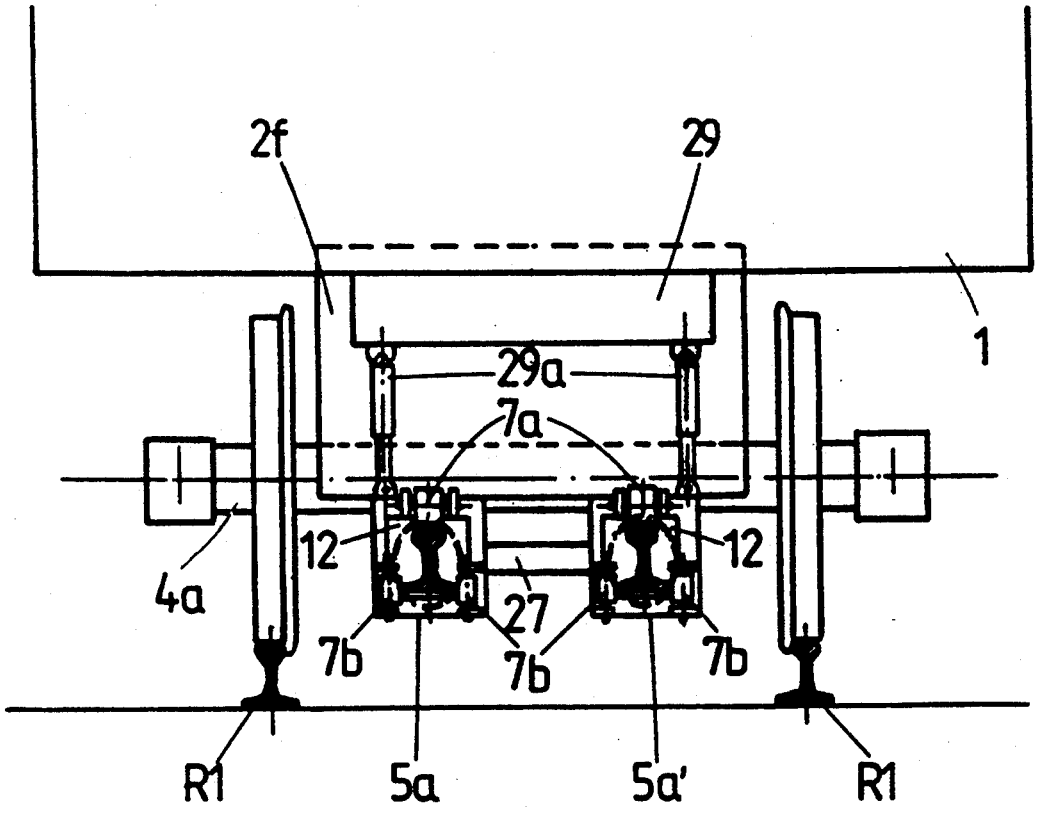

According to the variant of FIG. 7, the two sections 5a, 5a' of the tunnel provided for each stretch of rail are spaced, connected by a traverse 27 and suspended from the framework 29 by means of jacks 29a which permit to lift them when the vehicle is running light. Each tunnel is provided not only with rollers 7a bearing on the rails R2 but also with rollers 7b on both sides of each rail for the lateral guiding.

In order to detach the old rails R1, there are provided detaching units on two platforms 9, 10 which are suspended from a framework 29; these platforms are equipped with tools for disassembling the fixtures, such as automatic sleeper-screw drivers 9b, 10b, and are supplied with wheels 9d, 10d in order to run on the rails R1.

At the rear, the vehicle 1 comprises rail-guides 33 for the old rails R1 that are released, a cantilevered frame 30 carrying an adjustable support 31 provided with rail lifters 31a which lift the rails R1 (FIG. 4) and move them apart (FIG. 4a), as well as a tracked conveyor 32 running on the sleepers in order to prevent them from leaving the ballast during the lifting of the rails R1. The frame 30 may be displaced towards the interior of the vehicle by virtue of the rollers 30a running on slide bars on the framework 29.

The assembly vehicle 40 (FIG. 5), having the bogies 35 and 36, runs on the new rails R2 which are laid in their correct position on the sleepers ahead of the bogie 35. For this purpose, the vehicle comprises, at the front, a cantilevered frame 37 supplied with an adjustable support 38 carrying rail lifters 39 for moving the rails R2 apart towards the fixing positions, as FIG. 5a shows. The frame 37 may be displaced towards the interior of the vehicle by virtue of the rollers 37a running on slide bars of the framework 40a.

Below the framework 40a of the vehicle 40 are mounted an auxiliary heating tunnel 5c, which is positioned in front of the vehicle and covering the rails R2 from the top, and other rail lifters 39a for the positioning of these rails R2 on the sleepers T. This auxiliary tunnel 5c comes into operation only after an interruption in the work for reheating the rails R2 that have already left the tunnel 5a, 5b before their fixing.

A connection 41 between the vehicles 1 and 40 comprising an electrical line and a cooling duct serves to power this part 5c of the tunnel.

Vehicle 40 comprises moreover cabins at the front 42 and the rear 43, a generator set 44 and assembly stations on the two platforms 45. These platforms are suspended from the framework 40a and are supplied with tools for the assembly of the fixtures, especially automatic sleeper-screw drivers 46, as well as wheels 45a to run on the rails R2. The old rails R1 are guided by guide rollers 47 and are deposited by the side of the track as FIG. 5a shows.

At the rear of the vehicle 40 are provided means 48 for collecting the fastenings disassembled by the detaching units of the vehicle 1 and deposited on the track. These fastenings are transported by conveyors 48a to storage places 49 and by conveyors 50 to the fastening units on the platforms 45.

Figure 3:
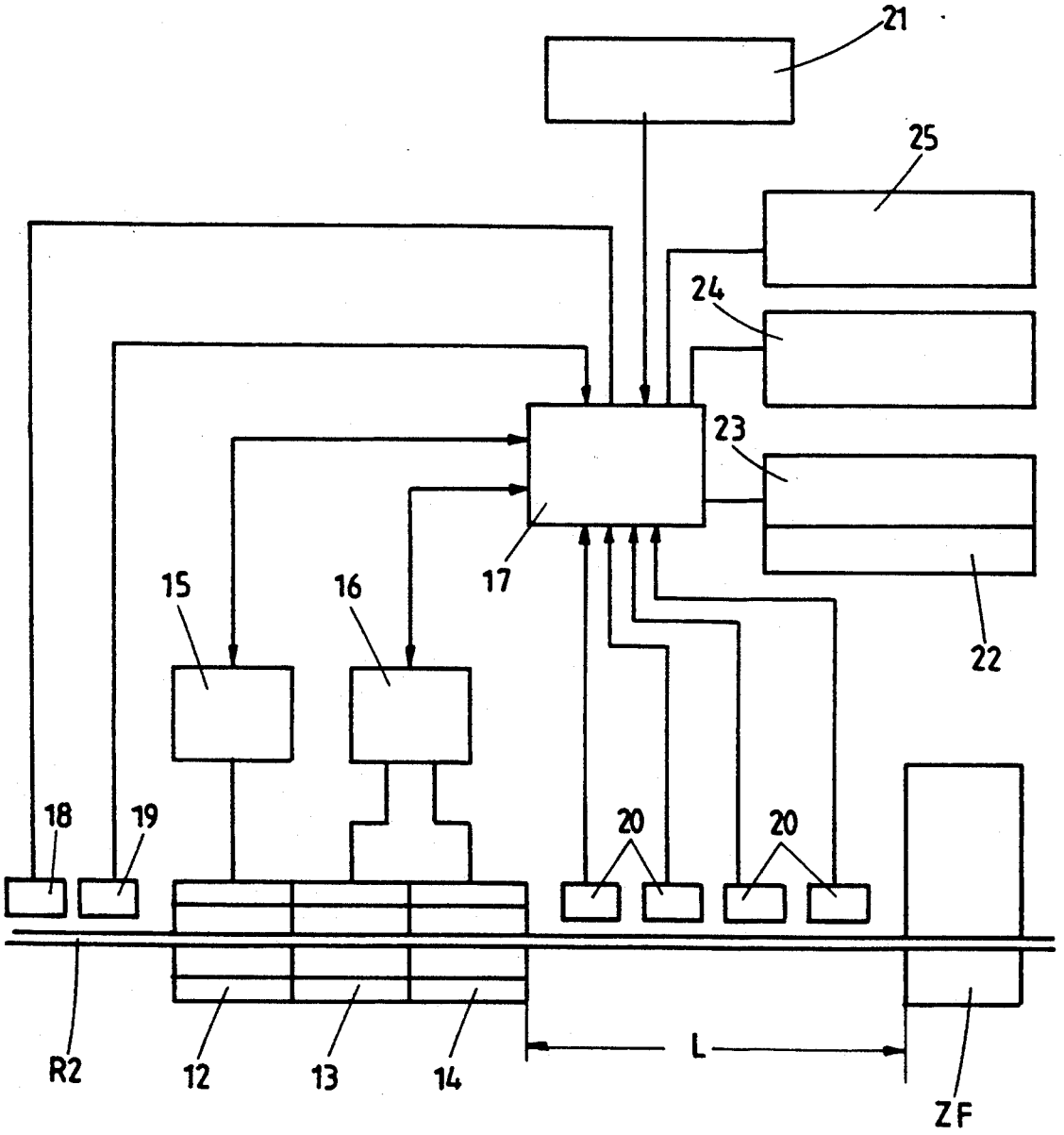
FIG. 3 is the block diagram for control of an installation for the high-frequency induction heating according to the invention.
Figure 8:
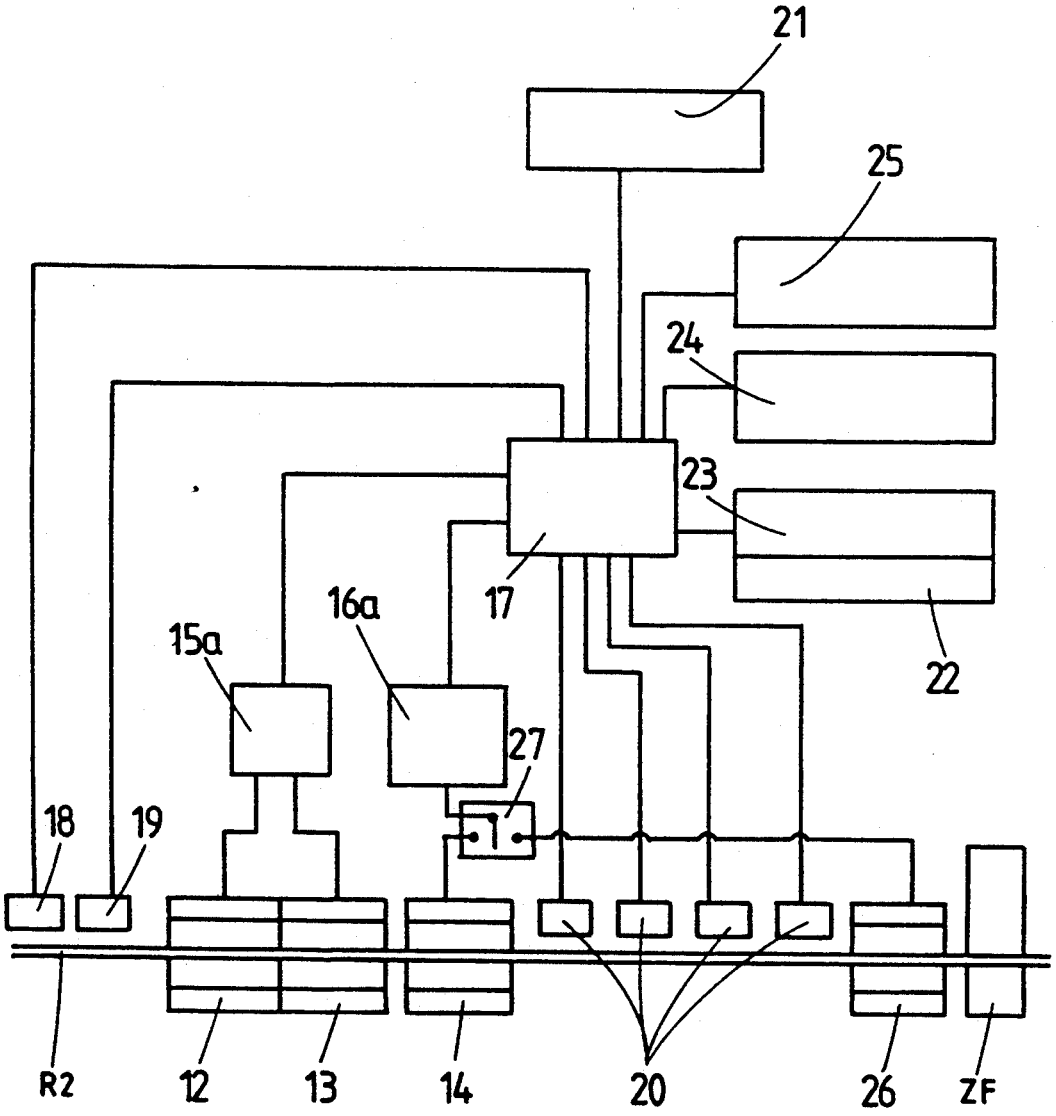
FIG. 8 is the block diagram control of an installation for the heating, which installation is adapted for the device according to FIGS. 4 and 5.

FIG. 8 shows the block diagram of the installation intended for the vehicles 1 and 40 according to FIGS. 4 and 5 and is very similar to that illustrated in FIG. 3. The same units are designated by the same reference symbols and will not be described again. The modifications in relation to FIG. 3 are the following:

An inverter 15a, of 50 kW rms power, supplies the two inductors 12, 13 mounted in each part 5a of the tunnels, and an inverter 16a, of 100 kW rms power, supplies the inductor 14 mounted in each part 5b of the tunnels or else an auxiliary inductor 26 mounted in each part 5c of the tunnels at the front of the vehicle 40. An inverter 27 permits the connection of the inverter 16a to the inductor 14 or 26. In this case the inverters work at 2 kHz. Each inductor, designed as a module, is formed by a hollow one-turn coil and its length is 1 m.

Of course, the process according to the invention may be implemented by installations other than those which have just been described, in particular the source of heat could be different. High-frequency induction heating, which is the preferred heating, could especially be replaced by electrical resistance heating or by heating with gas.

I claim:

1. A process for on-track neutralization of the rails of a railway, comprising the steps of:

continuously moving at least one heating element along the rails to expose the rails to high-frequency induction heating and form a heating zone;

continuously meausring a temperature of the rails prior to their exposure to high-frequency induction heating;

measuring a speed of movement of said at least one heating element relative to the rails;

measuring a change in the temperature of the rails after high-frequency induction heating until a point of on-track fixing; and controlling said at least one heating element based on the measured change in temperature.

2. A process as in claim 1, wherein a distance between the heating zone and the point of on-track fixing is chosen, for a given speed of movement, so that a difference in temperature between a surface and a core of the rails does not exceed a predetermined value and so that a temperature of the rails at the point of on-track fixing is substantially equal to a desired temperature.

3. An apparatus for implementing the process according to claim 1, wherein the apparatus includes a vehicle comprising:

at least one heating element, said at least one heating element including an inductor;

at least one investor connected to said inductor in order to supply high-frequency power to said inductor;

means for measuring a speed of the vehicle along the rails;

sensors for measuring the temperature of the rails before their exposure to heating and after their exposure to heating so as to measure the change in the temperature of the rails;

an electronic control unit connected to said invertor, said means for measuring speed and said sensors; and input means coupled to said electronic control unit for inputting external information and set-point values.

4. An apparatus as in claim 3, wherein said vehicle further comprises a printing device and an optical display unit coupled to said electronic control unit.

5. An apparatus as in claim 3, wherein said vehicle further comprises an auxiliary inductor mounted at a front end of said vehicle.

6. An apparatus as in claim 5, wherein said auxiliary inductor is powered by a second invertor mounted on said vehicle.

7. An apparatus as in claim 3, wherein said vehicle further comprises a plurality of inductors formed by hollow, one-turn coils, said coils being prefabricated as modules and cooled by circulation of a cold liquid through the coils.

* * * * *